US007467660B2

(12) United States Patent
Steinberg

(10) Patent No.: US 7,467,660 B2
(45) Date of Patent: Dec. 23, 2008

(54) PUMPED CARBON MINING METHANE PRODUCTION PROCESS

(75) Inventor: Meyer Steinberg, Melville, NY (US)

(73) Assignee: HCE, LLC, Oakton, VA (US)

( * ) Notice: Subject to any disclaimer, the term of this patent is extended or adjusted under 35 U.S.C. 154(b) by 283 days.

(21) Appl. No.: 11/308,517

(22) Filed: Mar. 31, 2006

(65) Prior Publication Data

US 2006/0219403 A1 Oct. 5, 2006

Related U.S. Application Data

(60) Provisional application No. 60/594,364, filed on Mar. 31, 2005.

(51) Int. Cl.
*E21B 43/00* (2006.01)

(52) U.S. Cl. ..... 166/267; 166/309; 166/272.1; 166/302; 166/266; 48/127.3; 48/213

(58) Field of Classification Search ..... 48/127.3, 48/213; 518/726, 702, 703, 704; 166/245, 166/250.1, 257, 261, 266, 267, 272.1, 302, 166/308.1
See application file for complete search history.

(56) References Cited

U.S. PATENT DOCUMENTS 3,779,725 A * 12/1973 Hegarty et al. ..... 48/202
3,938,968 A * 2/1976 White et al. ..... 48/215

(Continued)

OTHER PUBLICATIONS

Lambertz, et al., "Recent Operational Results of the High Temperature Winkler (HTW) and Hydrogasification (HKV) Process," Second EPRI Conference on Synthetic Fuels in San Francisco, CA, Apr. 1985, all pages.

(Continued)

*Primary Examiner*—Zakiya W. Bates
*Assistant Examiner*—Angela M DiTrani
(74) *Attorney, Agent, or Firm*—Louis Ventre, Jr.

(57) ABSTRACT

The invention is a continuous process for producing methane from an underground coal bed or an above ground carbon-containing resource using hydrogen as a recycling working fluid. For an underground coal seam, the process includes injecting (220) hydrogen into the coal seam to form a reaction effluent of methane, hydrogen and carbon monoxide; extracting the reaction effluent (230) for processing above ground; cleaning the reaction effluent (120); cooling the cleaned reaction effluent (130) and processing it through a water gas shift reactor (140); separating (150) hydrogen, methane, and carbon dioxide into separate streams; producing the carbon dioxide stream (160) as a product gas; processing a first portion (170) of the methane stream in a steam reformer, water gas shift reactor and gas separator (180) to produce segregated flows of hydrogen and carbon dioxide, combining the segregated hydrogen flow with the separated hydrogen stream (190); heating and repressurizing (200) the combined hydrogen stream to the temperature and pressure of the hydrogen in the first step; producing a second portion (210) of said methane stream as a product gas; and injecting (220) the combined hydrogen stream into the underground coal bed to continue the process.

17 Claims, 1 Drawing Sheet

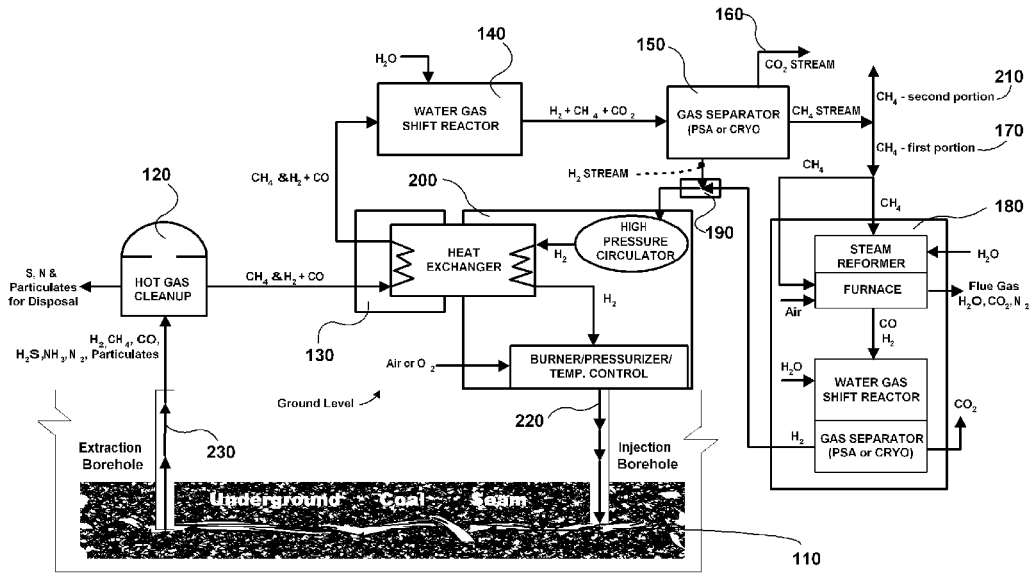

U.S. PATENT DOCUMENTS

| | | | | |
|---|---|---|---|---|
| 4,133,825 | A * | 1/1979 | Stroud et al. | 518/708 |
| 4,209,305 | A * | 6/1980 | Conway et al. | 48/213 |
| 4,367,077 | A * | 1/1983 | Tao | 48/213 |
| 6,712,135 | B2 | 3/2004 | Wellington et al. | |

OTHER PUBLICATIONS

Steinberg, Underground Coal Gasification (UCG-Hydrocarb Process) for Producing a Clean Carbon Fuel and Hydrogen, Process Sciences Division, Brookhaven National Laboratory, BNL-39117, Dec. 1986, all pages.

Steinberg, et al., "Pumping Carbon and Hydrogen Out of the Ground Using the Underground Coal Hydrogasification Hydrocarb Process (UCHG-HCP)," 14th Annual Underground Coal Gasification Symposium, Chicago, Ill, Aug. 15-18, 1988, also Process Sciences Division, Brookhaven National Laboratory, BNL-41634, Jul. 1988, all pages.

* cited by examiner

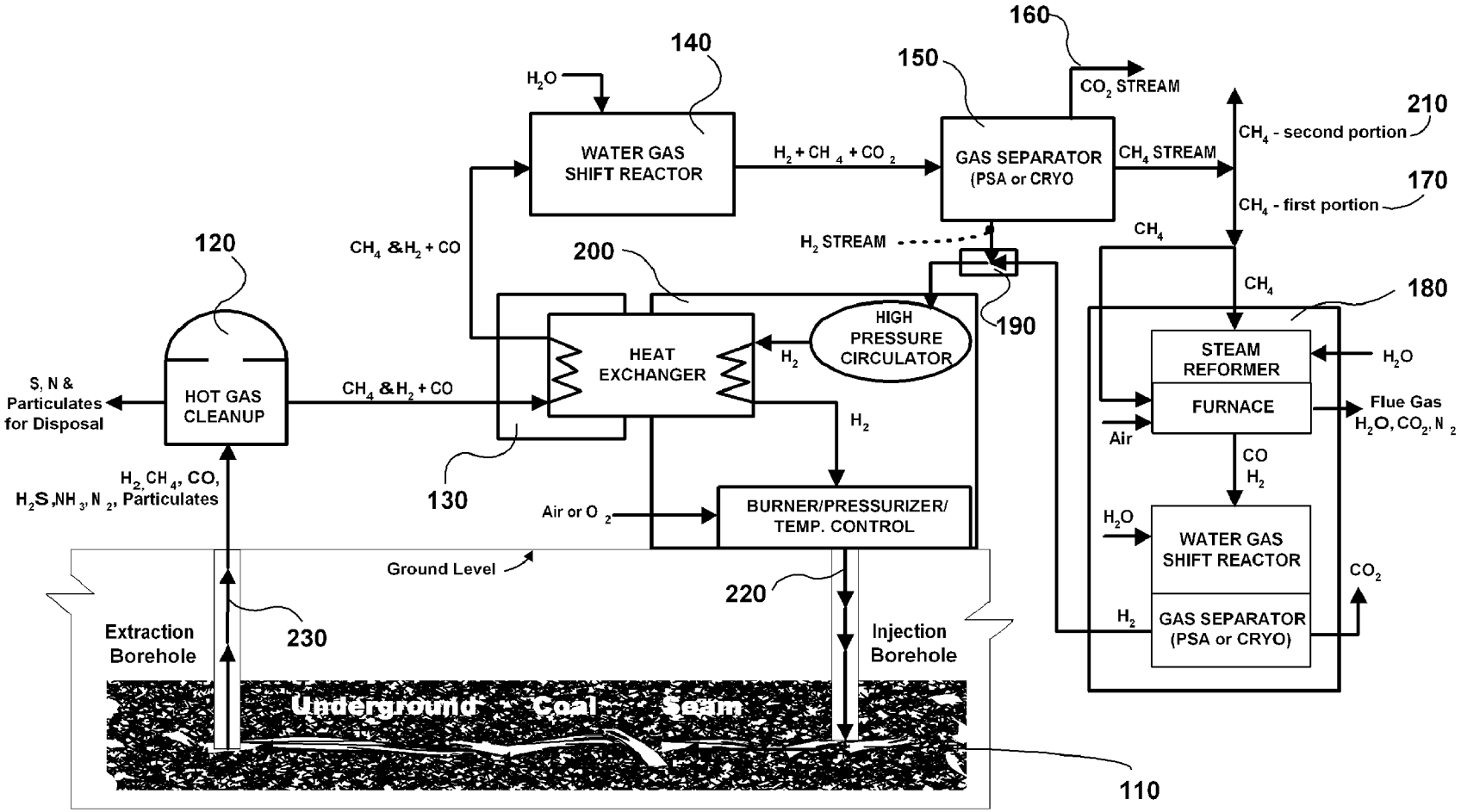
210
170
180
$CH_4$ - second portion
$CH_4$ - first portion
$H_2O$
Flue Gas
$H_2O, CO_2, N_2$
$CO_2$
$CH_4$
STEAM REFORMER
FURNACE
CO
$H_2$
WATER GAS SHIFT REACTOR
GAS SEPARATOR (PSA or CRYO)
Air
$H_2O$
$H_2$
$CO_2$ STREAM
$CH_4$ STREAM
160
150
GAS SEPARATOR (PSA or CRYO)
190
110
HIGH PRESSURE CIRCULATOR
$H_2$
BURNER/PRESSURIZER/ TEMP. CONTROL
Injection Borehole
$H_2 + CH_4 + CO_2$
$H_2$ STREAM
140
WATER GAS SHIFT REACTOR
$H_2O$
200
HEAT EXCHANGER
220
Air or $O_2$
Underground Coal Seam
130
Ground Level
$CH_4$ & $H_2$ + CO
$CH_4$ & $H_2$ + CO
230
120
HOT GAS CLEANUP
Extraction Borehole
$H_2$, $CH_4$, CO, Particulates
S, N & Particulates for Disposal
$H_2S, NH_3, N_2$

PUMPED CARBON MINING METHANE PRODUCTION PROCESS

In the field of substitute natural gas production from underground coal beds and other carbon-containing resources, a self-contained, continuous process to manufacture methane from using a recycling hydrogen stream.

BACKGROUND OF THE INVENTION

The invention provides a means to manufacture methane, or substitute natural gas, more or less continuously from underground coal seams, or from other carbon-containing resources either above ground or underground, such as carbon, peat, biomass, oil, tar sands and any hydrocarbon, using a recycling hydrogen stream. Hydrogen is made in the process and no external source of hydrogen is needed after the initial charge. The process operating on the carbon-containing resource involves a chemical reaction induced by pressure and heat that does not involve combustion of the carbon-containing resource and wherein the process is sustained by heat is generated by chemical reaction with carbon-containing resource.

In its preferred embodiment, the process produces methane from coal without having to remove the coal from its underground location. It is conservatively expected that the process can extract about 90% of carbon in the coal seam with a thermal efficiency of about 80%. This means that about 46% of the extracted carbon or 41% of the carbon in the underground lignite is converted to substitute natural gas and produced from the process for sale or other use. The remainder of the extracted carbon is produced as pure carbon dioxide for sale, sequestration or discharge. The process also has application to above ground carbon-containing resources.

One example of utility of the process is for example where the underground coal operation has been closed after recovery of coal bedded methane. The coal formation is essentially abandoned at this stage. However, the pumped carbon mining methane production process, applied to this depleted resource, offers a potential to produce an additional 20 times more methane than was obtained from the original coal bedded methane operation.

DESCRIPTION OF THE PRIOR ART

The process of the invention uses a hydrogasification step in which hydrogen is used as a recyclable working fluid. Hydrogasification is hydrogenation carried to point that a carbon-containing resource is gasified. The hydrogen reacts to make methane and extracts carbon monoxide from the fuel resource when oxygen is present in the carbon-containing resource, as it is in coal. Much research and development effort has been performed on hydrogasification of coal and mostly in an above ground setting, since the underground applications were perceived to have insurmountable problems.

The concept of pumped carbon mining in a manner different from the present invention was first introduced in 1986 by Steinberg. The concept proposed hydrogasifying underground coal to produce methane and then decomposing the methane to produce carbon black and hydrogen, the latter of which is recycled to continue to the process. While the process could produce carbon black and hydrogen, the process was never deployed commercially because the limited carbon black market and too small amount of hydrogen product.

The 1986 process held little prospect for simply using the methane as a product from a hydrogasification step because it would require a new supply of hydrogen for each pass and would free an insufficient amount of hydrogen from the coal seam to have a self-contained, continuous process. The difficulty of applying the process using hydrogen for methane production is that hydrogen is considered too expensive to find a hydrogen source to make up the hydrogen consumed in the process. The practical problem of hydrogen supply had foreclosed the practical utility of this 1986 process in favor of the conventional approach to underground coal gasification.

In contrast, the present invention produces the more valuable methane product, and not the less valuable carbon black, while solving the problem of hydrogen availability. The present invention makes use of recycling hydrogen in a continuous process that does not require a source of hydrogen external to the process. The present invention, therefore, overcomes the drawbacks of the earlier described process and in addition produces a valuable gaseous fuel, natural gas.

The conventional approach to underground coal gasification is to inject oxygen or air and steam into the underground coal bed. In conventional coal gasification, the oxygen and steam convert coal by in-situ steam/oxygen gasification, producing a gas effluent consisting mainly of carbon monoxide and hydrogen. The gases formed constitute a synthesis gas, which is a mixture of hydrogen, carbon monoxide and carbon dioxide, ranging from a low Btu gas (70 to ~100 Btu/ft$^3$) to an intermediate Btu gas (300 to 400 Btu/ft$^3$), depending on whether air or oxygen is used.

The effluent synthesis gas from conventional underground conventional coal gasification is processed at the surface, using techniques similar to those in conventional surface gasification, mainly for the purpose of removing sulfurous gases and ash particulates. The bulk of the ash remains in the coal bed. The synthesis gas can also be converted by means of water gas shift, methanation and other catalytic processes to form high Btu gas and liquid hydrocarbon and alcohol fuels.

The advantage of conventional underground coal gasification is avoiding costly underground mining operations, particularly for thin, steeply inclining and unminable seams. Avoiding environmental problems of conventional surface mining, such as the disposal of gangue and ash of mined coal are additional advantages.

Disadvantages of conventional underground coal gasification are the high cost to generate steam and oxygen at the surface and the associated environmental and other costs of burning some of the coal underground to provide the endothermic heat of reaction necessary for the steam gasification reaction. These disadvantages are avoided by the process.

Under the best conditions, conventional steam gasification requires consumption of at least ⅓ of the coal to provide the endothermic heat of reaction. This also produces large emissions of waste carbon dioxide. Heat losses and high rates of reaction reduce the mass and energy efficiency even further.

Conventional steam gasification also raises safety issues associated with the need to inject oxygen into the coal seam. Injected oxygen enables combustion of the coal, which in turn provides the endothermic energy as described above. However, safety issues arise when there is incomplete combustion of the oxygen. The presence of unconsumed oxygen can result in explosive mixtures of gas in the seams and in the effluent gas.

The hydrogasification step is expected to be superior to conventional coal gasification in cost, efficiency, safety and environmental performance. It is a low-energy mining process.

Steady state operations of the underground hydrogasification step in the process involve no burning of coal in the coal bed, no addition of steam and no addition of oxygen. The process provides for the occasional optional use of oxygen, and only if needed to control the hydrogasification process by forming water in the hydrogen stream prior to injection. This optionally provides a control mechanism of the exothermic hydrogasification reaction in the coal bed.

Unlike conventional coal gasification, the gases formed in hydrogasification in the process are always in a reducing atmosphere, which avoids the possible formation of an explosive mixture in the conventional case of unreacted oxygen, thus making the process safer than the conventional coal gasification process.

Methods of pyrolyzing, that is heating and decomposing, underground coal seams have been proposed. For example, U.S. Pat. No. 6,712,135 to Wellington, et al. teaches heating a section of an underground coal seam with electrical heaters or combustors to produce hydrogen from the coal seam, then heating another section and circulating the produced hydrogen between the sections to produce a mixture of hydrocarbons. The '135 patent also instructs heating the coal seam to enable pyrolysis at temperatures of less than about 400 degrees Centigrade. The process of the '135 patent, therefore, produces only higher hydrocarbons and only a minor amount of methane. It does not instruct using an external source of hydrogen of much greater volume as recyclable working fluid, or using hydrogen at the temperatures and pressures of the present invention for hydrogasification, or producing SNG, substitute natural gas.

The present invention will improve the safety, efficiency and economy of recovery of clean carbon, hydrogen and carbon monoxide fuels from underground coal deposits. The present invention is applicable to underground coal beds, with a primary application to coal resources that are considered unminable by traditional coal mining operations. It has application to deep depleted coal mines where significant quantities of coal have been left behind, in room and pillar mining to maintain structure. The process could extract the pillar coals ("robbing the pillars") and maintain structure by pumping in rock or dirt fill to prevent subsidence. Secondary applications are for peat and other coal deposits as well as above ground carbonaceous fuel resources.

Accordingly, the present invention will serve to improve the prior art in terms of cost, efficiency, safety and environmental performance. The present invention is a self-contained process, that is, one not requiring an off-site source of make-up hydrogen. When used for in-situ mining, the process will continuously produce methane until the coal resource is depleted. When underground hydrogasification is combined with above ground processing, the present invention provides a distinct, unique and innovative improvement over the state of the art of underground coal gasification. These and other features, improvements and advantages of the present invention will be better appreciated and understood by reference to the detailed description taken in conjunction with the accompanying drawing.

BRIEF SUMMARY OF THE INVENTION

The invention is a continuous process for producing methane from an underground coal bed or an above ground carbon-containing resource using hydrogen as a recycling working fluid. For an underground coal seam, the process includes injecting hydrogen into the coal seam to form a reaction effluent of methane, hydrogen and carbon monoxide; extracting the reaction effluent for processing above ground; cleaning the reaction effluent; cooling the cleaned reaction effluent and processing it through a water gas shift reactor; separating hydrogen, methane, and carbon dioxide into separate streams; producing the carbon dioxide stream as a product gas; processing a first portion of the methane stream in a steam reformer, water gas shift reactor and gas separator to produce segregated flows of hydrogen and carbon dioxide, wherein the quantity of said first portion is the amount of methane that will yield after such processing a quantity of hydrogen that when combined with the separated hydrogen stream will equal an amount of hydrogen at least equal to the amount needed to sustain a continuous operation of the process; combining the segregated hydrogen flow with the separated hydrogen stream; heating and repressurizing the combined hydrogen stream to the temperature and pressure of the hydrogen in the first step; producing a second portion of said methane stream as a product gas; and injecting the combined hydrogen stream into the underground coal bed to continue the process.

BRIEF DESCRIPTION OF THE DRAWINGS

The drawing shows the preferred embodiment of the invention for producing methane from an underground coal seam.

DETAILED DESCRIPTION OF THE INVENTION

The invention is a self-contained, continuous process for methane production from any underground (shown in the drawing) or above ground carbon-containing resource. Hydrogen is used as a recycling working fluid. For use in an underground coal formation, hydrogen is produced both from the coal and also from an aboveground reforming step, such that the process does not require a hydrogen supply beyond the initial charge of hydrogen to initiate the process. While the steps described herein are the preferred embodiment, the invention includes variation of the order of process steps as long as output of a methane product is the result.

Hydrogasifying (110). The first step in the process is hydrogasifying a carbon-containing resource using hydrogen at a temperature and pressure sufficient to form a reaction effluent composed primarily of methane, hydrogen and carbon monoxide. This step may be performed above ground in a reaction chamber containing a hydrocarbon fuel, or underground, for example in a coal seam. Typically, the hydrogen is at a temperature between about 700 and 1000 degrees Centigrade and at a pressure is between about 50 and 100 atmospheres. For underground embodiments, the optimum pressure is primarily dependant upon the depth of the hydrocarbon and the reaction rate. For above ground embodiments, the optimum pressure is primarily dependant on the reaction rate.

Underground Coal Bed Preparation. For underground coal resources, the process works best in the absence of water during hydrogasification. The presence of water promotes steam gasification of the coal to form carbon monoxide, retards methane formation and causes heat loss.

There is less water associated with the coal in deep mine eastern bituminous coal than for western lignite. For eastern bituminous coal, the water content is typically about 0.086 moles water per mole of carbon in the coal with no significant amounts of methane. For western lignite, especially in the North Dakota, Montana and Wyoming deposits (Powder River Basin deposits), it is on the order of 0.46 moles water per mole of carbon in the coal.

The initial methane content of the coal bed is also a consideration for optimal performance. The process will work best if the methane is first removed from the coal bed. For eastern bituminous coal, there are no significant amounts of methane. Some of the western lignite coal beds contain significant quantities of methane (coal bedded methane), which are economically recoverable.

For either eastern or western coal beds where the water has not been previously removed and where it is necessary to improve initial operations, the coal bed is dried, for example, by circulating dry, heated hydrogen through the underground coal bed at temperatures of not more than about 400° C. Combustion of any fuel equivalent to the heating value of 0.07 moles of hydrogen per mole of lignite is required to provide the heat to evaporate and remove the entire 0.46 moles of water per mole of lignite carbon. Where a coal bedded methane extraction has been performed, a fraction of the water will have been removed with the methane. As a consequence, much less energy to evaporate the water will be needed.

The process of the invention is an ideal complement to a coal bedded methane extraction operation. A typical western coal bedded methane extraction operation includes drilling boreholes and horizontal drilling in the seams to release the coal bedded methane. In some cases, a significant amount of water is simultaneously extracted with the removal of the methane. Once the seam is depleted by coal bedded methane production, the process of the invention would be employed to further exploit the coal seams. The process of the invention enables an increase of methane production by as much as 20 times that obtained from the coal bedded methane production operation.

Using Underground Coal Seams. In an embodiment for underground coal resources, after the coal bed is degassed and dried, the temperature of the hydrogen is then raised to the steady state operating temperature and pressure to begin the hydrogenation of coal, also called hydrogasification, and formation of methane. For this embodiment, a required process step is injecting hydrogen (220) into an underground coal bed at a temperature and pressure sufficient to form a reaction effluent composed primarily of methane, hydrogen and carbon monoxide. Hydrogasification is the combination of hot, pressurized hydrogen with carbon in the coal to produce methane. For this embodiment, the next step is extracting (230) the reaction effluent for processing above ground.

Typically, the volumetric concentration of methane produced is equilibrium limited. Under the high temperature and pressure conditions, a concentration of methane of about 40% by volume has been obtained in one pass in testing of hydrogasification. For the process of the invention, the temperature and pressure conditions are adjusted to obtain the highest concentration of methane to minimize recirculating hydrogen pumping costs and still maintain high rates of reaction.

In addition to methane, hydrogen is also released from the coal in the form of hydrogen gas. Part of the oxygen within the coal combines with carbon in the coal evolving carbon monoxide gas. Part of the sulfur in the coal is converted to hydrogen sulfide gas. Part of the nitrogen in the coal is converted to ammonia and nitrogen gas. The non-volatile solid ash in the coal remains underground and the ash minerals in the coal bed have potential to act as catalysts to increase the rate of reaction.

Aside from the contaminant gases, the extracted reaction gas has approximately the following composition: methane—40 volume percent; carbon monoxide—10 volume percent; and hydrogen—50 volume percent.

For the underground embodiment, injecting hot, pressurized hydrogen (220) into an underground coal seam is typically accomplished through an injection borehole drilled from the surface into the coal bed. The underground embodiments will work with numerous configurations of boreholes accessing the coal seam and is not limited to any particular arrangement. For example, a single borehole may be used to implement the process, in which case that single borehole would be used for injection of the hydrogen and extraction of the reaction effluents. In addition, multiple injection boreholes might be used with any combination of extraction boreholes. The preferred embodiment uses at least one injection borehole and at least one other extraction borehole.

For hydrogasification, the hydrogen is preferentially at a temperature no lower than about 600° C. and at a pressure no lower than about 50 atmospheres (atm). Generally, the higher the temperature and pressure, the faster and more complete the reaction becomes. Temperatures of 800-1000° C. and pressures of 50-100 atm of high concentrations of hydrogen have yielded over 90% conversion of the carbon in coal to methane and higher hydrocarbons. The specific pressure-temperature conditions depend on the type of coal and the reaction rate. These specific conditions are determined by laboratory experiments using the carbon-containing resource. For underground embodiments, the carbon-containing resource would typically be coal within a coal seam.

The hydrogenation process is exothermic. Once the reaction is initiated, no additional heat source is necessary to maintain thermal reaction conditions.

The basic hydrogenation reaction with carbon is exothermic:

$$C+2\,H_2=CH_4\ \Delta H=-18\ \text{Kcal/mol, exothermic}$$

Coal is used as the primary example herein because underground coal is expected to be the primary application for the process. However, the invention contemplates the use of any hydrocarbon, whether above ground or below.

Coal consists of more than carbon. So, the general hydrogasification reaction for coal can be represented by the following equation:

$$\text{Coal+Hydrogen=Methane+Hydrogen+Carbon monoxide+Sulfide+Nitrogen+Ash}$$

For a typical eastern bituminous coal (Kentucky), the stoichiometric equation is $$CH_{0.8}\,O_{0.08}\,S_{0.016}\,N_{0.015}\,(\text{Ash})+1.456H_2=0.92CH_4+0.08CO+0.016H_2S+0.008N_2+\text{Ash}$$

From the enthalpy of formation of each of the reactants and products, ΔH, the enthalpy of this reaction, is −15.7 Kcal/mol, exothermic.

For a western lignite coal (N. Dakota Lignite), the stoichiometric equation is $$CH_{0.77}\,O_{0.24}\,S_{0.007}\,N_{0.013}\,(\text{Ash})+1.142H_2=0.76CH_4+0.24CO+0.007H_2S+0.007N_2+\text{Ash}$$

From the enthalpy of formation of each of the reactants and products, ΔH, the enthalpy of this reaction, is −10.1 Kcal/mol exothermic.

High temperature hydrogen injected into the coal bed helps maintain the temperature in the reaction zone. However, if heat losses underground become excessive, make-up heat is supplied by combusting a small amount hydrogen with oxygen or air just prior to injecting the hydrogen underground. Once reaction temperature and pressure conditions are reached in the coal bed, the heat released in the exothermic hydrogenation reaction sustains the process.

Combusting hydrogen (200). One of the steps in the process is heating and repressurizing the combined hydrogen stream to the temperature and pressure of the hydrogen in the first step. This step is preferably performed using a burner isolated from the hydrogen stream and fired either by methane or hydrogen. This step optionally includes combusting hydrogen with oxygen or air within the hydrogen injection stream as a hydrogasification reaction control. Burning hydrogen in the hydrogen stream creates water and water dampens the exothermic hydrogenation reactions underground. Such control may or may not be needed but is enabled because the water formed reacts endothermically with the coal countering the exothermic hydrogenation, and thus prevents any hot spot runaway reaction. This reaction control technique, effectively dowsing the reaction zone with water, has been successfully used in hydrogasification of coal in an above ground hydrogenation plant. Temperature sensors in the extraction borehole are utilized to fine tune and initiate this reaction control technique.

Methane Extraction (230). For embodiments of the invention in underground coal seams, the next step in the process is extracting the reaction effluent from the underground coal bed for processing above ground. The methane-rich reaction gas formed by hydrogasification is preferentially removed from the coal bed by allowing the reaction gas to flow out an extraction borehole to the surface. Employing an extraction borehole is a common practice in the industry in conventional in situ coal gasification and when extracting coal bedded methane.

The injection and extraction boreholes are connected by a flow path through the coal seam created by means typically employed in conventional underground steam gasification and coal bedded methane extraction. This connection provides a pathway and reaction zone wherein the pressurized, heated hydrogen introduced through the injection borehole reacts with the coal seam.

Several techniques have been used to create a flow path between the injection and extraction boreholes. Horizontal drilling between an injection borehole and an extraction borehole has been successfully used in obtaining methane from unminable coal beds. Another technique is to inject oxygen (purified or contained in air) into the seam through one borehole at high enough pressure to produce a small airflow through the seam to a second borehole. The coal is then burned at the base of the second borehole and the burn front follows the oxygen back to the first borehole, creating a path through the coal seam. Where a flow path is not preexisting and must be opened, the preferred embodiment is to open a path by hydrogasification, that is, injecting high pressure and high temperature hydrogen rich gas.

As the hydrogasification reaction and reaction gas extraction steps proceed, the flow path permeability of the coal bed from injection borehole to extraction borehole is enlarged, which increases the hydrogasification reaction and the production of methane rich gas from the coal bed.

Hot Gas Cleanup (120). The next step in the process is cleaning the reaction effluent to remove gases other than methane, hydrogen and carbon monoxide and particulates. Upon extraction of the methane-rich reaction gas to the surface, a hot gas cleaning process removes the impurities, e.g. sulfur, nitrogen, ammonia, residual entrained fly ash and other contaminants.

Several alternative hot gas cleanup processes are well known to remove sulfurous gas from the effluent. Two of these include reacting the effluent with zinc ferrite or limestone. Part of the inorganic sulfur present in the in situ coal, depending on the type of coal, remains with the ash, underground.

The nitrogen in the coal is evolved as both ammonia and nitrogen. Therefore, the nitrogen and sulfur can be disposed of as calcium sulfate or ammonium sulfate. Disposal as used herein includes selling the product for other uses should a market exist for the product.

At temperatures above about 800° C., most of the oxygen released from the coal will form carbon monoxide and very little will be in the form of carbon dioxide and water, especially when there are high hydrogen to oxygen ratios in the circulating gas. Under high pressure (50 to 100 atmospheres) and moderately high temperatures, a large part of the carbon effluent from the coal will be in the form of methane diluted with circulating hydrogen.

Ceramic candle filters have been used for hot gas cleanup from fluidized combustion furnaces. Cyclones can also remove particulates at lower temperatures and if employed would require a heat transfer process to initially lower the gas temperature and raise it again subsequent to processing.

The combination of readily available hot gas cleanup processes result in a cleaned gas being a concentrated stream of methane, hydrogen and carbon monoxide.

Cooling (130). The next step in the process is cooling the cleaned reaction effluent to a temperature suitable for processing in a water gas shift reactor. The hot gas from the previous step is sent through a heat exchanger where the gas temperature is reduced to about 250 degrees Centigrade while maintaining the pressure. This lower temperature gas is then sent to a water gas shift reactor where the following reaction occurs:

$$0.2\ CO+0.2\ H_2O=0.2\ CO_2+0.2\ H_2\ \Delta H=0.0,\ \text{neutral}$$

Water Gas Shift (140). The next step in the process of the invention is processing the cooled reaction effluent through a water gas shift reactor to convert the carbon monoxide to hydrogen to a gaseous outflow of hydrogen, methane, and carbon dioxide. The water gas shift reaction is essentially thermally neutral. In the water gas shift, carbon monoxide is reacted with water (steam) at about 250 degrees Centigrade while maintaining the pressure of about 50 to 100 atmospheres pressure to form hydrogen and carbon dioxide. Hydrogen formed in this process permits reducing the amount of excess hydrogen circulating through the bed. Thus, only 1.0 mole of hydrogen is continually circulated through the system and the amount of hydrogen entering the borehole per mole of coal reacted is 2.2 gram-moles.

$$CH_{0.8}\ O_{0.2}+2.2\ H_2=0.8\ CH_4+0.2\ CO+1.0\ H_2$$

About 50% of the gas flow from the water gas shift reaction is hydrogen. About 40% is methane and the rest is carbon dioxide. More specifically, the gas emerging from the water gas shift has a relative content of about 0.8 gram-moles of methane for every 0.2 gram-moles of carbon dioxide for every 1.0 gram-mole of hydrogen.

Separation. The next step in the process of the invention is separating the water gas shift outflow of hydrogen, methane, and carbon dioxide into separate gas streams. In order to recirculate the hydrogen and produce Substitute Natural Gas (methane), the preferred embodiment removes methane into its own stream, and carbon dioxide into its own stream from the gas stream coming from the water gas shift. Thus, three separate streams result from this separating step, a hydrogen stream, a methane stream and a carbon dioxide stream.

Several methods are known in the art for removing methane and carbon dioxide, including: absorption/stripping in solvents, cryogenic separation, and pressure swing adsorption (PSA). The lowest cost gas separation process would preferably be used to separate the methane and carbon dioxide from the hydrogen.

From industrial experience in hydrogen plants, pressure swing adsorption has been used to remove carbon dioxide using a zeolite (molecular sieve) adsorbent. An alternative method of gas separation is cryogenic cooling. To remove methane using pressure swing adsorption, activated carbon is typically used.

In the preferred embodiment of the present invention, two separate pressure swing adsorption units are employed to separate the gas stream coming from the water gas shift reaction. However, an alternative embodiment would use a single unit of mixed adsorbent bed to adsorb both the carbon dioxide and the methane at the high pressure (about 50 to 100 atmospheres) and to intermittently differentially desorb at lower pressure (~10 atmospheres) and remove and produce carbon dioxide and methane separately. The hydrogen does not adsorb and passes through the adsorption bed maintaining pressure at 50 to 100 atmospheres. The carbon dioxide stream is recovered pure, so it is ready for sale, discharge, or sequestration. A portion of the methane stream is ready for pipeline distribution once it is adjusted to pipeline pressure and the remaining portion is ready for use to create additional hydrogen for reinjection. The hydrogen stream is made ready for reinjection. Once the gases are separated, the next steps operating on the separate gas streams occur more or less simultaneously. For simplicity, they are discussed as separate steps.

Carbon Dioxide Product (160). The next step in the process of the invention is producing the carbon dioxide stream as a product gas. The carbon dioxide gas is a pure product and may be sold for other uses, sequestered to isolate it from the atmosphere using one of the known techniques, or simply discharged to the atmosphere.

Methane Processing First Portion (170) and Methane Product Second Portion (210). The process of the invention next divides the methane stream into two portions: a first portion (170) that will be further processed to make hydrogen and a second portion (210) as a product of the process. The next three process steps describe the processes acting on the first portion of the methane (170). The fourth step following describes the action on the second portion (210).

Steam reformer, water gas shift reactor and gas separator (180). The next step in the process of the invention is processing a first portion (170) of the methane stream from the separating step in a steam reformer, water gas shift reactor and gas separator (180). This processing produces segregated flows of hydrogen and carbon dioxide. The first portion (170) is the amount of methane that will yield after such processing a quantity of hydrogen that when combined with the separated hydrogen stream from the previous step's separation will equal an amount of hydrogen at least equal to the amount needed to sustain a continuous operation of the process. Steam reforming makes hydrogen from water and from the methane. So the process derives hydrogen both from the methane and from water. The reforming process also produces carbon monoxide. The hydrogen and carbon monoxide stream is again water gas shifted to create more hydrogen from water and producing a pure carbon dioxide product stream from the carbon monoxide.

This processing step completes the mass balance of the preferred embodiment of the process. It is necessary to add 1 mole of hydrogen to the hydrogen stream coming from the separating step. This is done by reforming 0.25 moles methane by conventional steam reforming and water gas shift:

$$\text{Steam reforming } 0.25\ CH_4+0.25\ H_2O=0.25\ CO+0.75\ H_2$$

$$\Delta H=+15\ \text{Kcal}$$

The steam reforming is endothermic, requiring 15 Kcal, which is supplied by combusting methane in the reformer furnace, which at 80% efficiency requires an additional 0.09 moles of methane. The water gas shift completes the production of 1 gram-mole hydrogen. The reaction is thermally neutral $$0.25\ CO+0.25\ H_2O=0.25\ CO_2+0.25\ H_2$$

$$\Delta H=0$$

The carbon dioxide is removed by pressure swing adsorption (PSA). An alternative method of separation is cryogenic cooling. The total hydrogen production reaction is the sum of the two above:

$$0.25\ CH_4+0.5\ H_2O=0.25\ CO_2+H_2$$

The methane consumed in producing the 1 mole hydrogen needed to complete the mass balance is the sum of 0.25 $CH_4$+0.09 $CH_4$=0.34 $CH_4$ The net production of methane from this process is then the methane produced in the separating step minus the methane consumed 0.8 $CH_4$−0.34 $CH_4$=0.46 $CH_4$ Combining hydrogen (190). The next step in the process is combining the segregated hydrogen flow with the hydrogen stream from the separating step. The combined hydrogen stream is then of sufficient volume to reinject and continue the process. However, the temperature and pressure of the hydrogen stream must first be adjusted to those of the initial injection conditions. The combined hydrogen stream is at low temperature, typically greater than about 100 degrees Centigrade, from the separating process and the operating pressure may need some adjustment as well.

Heating and Repressurizing (200). The next step is heating and repressurizing the combined hydrogen stream to the temperature and pressure of the hydrogen in the first step. The preferred embodiment raises the temperature by heat exchanging the combined hydrogen stream with hot cleaned gas to raise the temperature to about 800° C. In this embodiment, a gas-fired heater makes up for heat losses and assures the hydrogen will be brought to the hydrogen injection temperature of 800-1000° C. and pressure of 50 to 100 atmospheres.

Methane second portion (210). The next step is producing a second portion of said methane stream as a product gas, wherein said second portion is the amount of methane not subjected to processing in the steam reformer, water gas shift reactor and gas separator. As noted previously, this step is performed more or less simultaneously with the other steps dealing with the three gas streams from the separating step.

Continuing the Process (220). The next step in the process is using the heated and repressurized hydrogen in the hydrogasifing step to continue the process. For underground embodiments, this typically means reinjecting the hydrogen into the coal seam. For above ground embodiments this typically means injecting the hydrogen in the reaction chamber.

The process of the invention is expected to have a conversion efficiently of coal carbon to methane carbon (substitute natural gas) as high as 90%.

The overall mass balance equation for producing Substitute Natural Gas by the preferred embodiment of the process of the invention from lignite is:

$$CH_{0.8}O_{0.2}+0.7\ H_2O=0.55CH_4+0.45\ CO_2$$

$$\Delta H=+5.2\ \text{Kcal/mol}$$

This endothermic energy is made up in the reformer. Subtracting the 0.09 gram-moles of methane gross production of 0.55 gram-moles, yields a net methane production of 0.46 gram-moles of methane. Thus, about 46% of the extracted carbon or 41% of the carbon in the underground lignite is converted to substitute natural gas and produced from the process for sale or other use.

In an alternative embodiment of the invention when there is no carbon monoxide formed in the hydrogasification step because the carbon containing resource, for example carbon alone, oil, or tar sands, does not contain oxygen, then mainly methane is formed. In this case, the first water gas shift is eliminated because of the absence of any significant quantity of carbon monoxide. Thus, the step of processing the cooled reaction effluent through a water gas shift reactor and the step of producing the carbon dioxide stream as a product gas are eliminated. The methane is separated into a first portion and a second portion as in the above-described preferred embodiment.

In an alternative embodiment, a single water gas shift reaction is used after the step of cooling the cleaned reaction effluent. Then, after the step of producing said carbon dioxide stream as a product gas, only a steam reformer used. The output hydrogen and carbon monoxide stream from the steam reformer is used as the recycling fluid in the hydrogasifying step. For this embodiment, the carbon monoxide in the recycling fluid eventually reaches an equilibrium level.

INDUSTRIAL APPLICABILITY

The process is applicable to the coal mining industry, the natural gas production industry, and the energy production industry. It is an enhanced mining process that is available through chemistry. It dramatically expands the potential for the economic recovery of coal-derived fuel from an otherwise unrecoverable domestic resource. It uses an inherently safe process. It is environmentally friendly process, which avoids the pollution typically associated with combusting coal products. It creates substitute natural gas from coal beds and above-ground energy resources.

While there has been described herein what is considered to be the preferred exemplary embodiment of the present invention, other modifications of the present invention shall be apparent to those skilled in the art from the teachings herein, and it is, therefore, desired to be secured in the appended claim all such modifications as fall the true spirit and scope of the invention. Accordingly, what is desired to be secured by Letters Patent of the United States the invention as defined and differentiated in the following claims in which

What is claimed is:

1. A continuous process for producing substitute natural gas and other products comprising the steps of, (a) hydrogasifying a carbon-containing resource using hydrogen at a temperature and pressure sufficient to form a reaction effluent composed primarily of methane, hydrogen and carbon monoxide;

(b) cleaning the reaction effluent to remove gases other than methane, hydrogen and carbon monoxide and particulates;

(c) cooling the cleaned reaction effluent to a temperature suitable for processing in a water gas shift reactor;

(d) processing the cooled reaction effluent through a water gas shift reactor to convert the carbon monoxide and hydrogen to a gaseous outflow of hydrogen, methane, and carbon dioxide;

(e) separating said outflow of hydrogen, methane, and carbon dioxide into separate streams;

(f) producing said carbon dioxide stream as a product gas;

(g) processing a first portion of said methane stream in a steam reformer, water gas shift reactor and gas separator to produce segregated flows of hydrogen and carbon dioxide, wherein the quantity of said first portion is the amount of methane that will yield after such processing a quantity of hydrogen that when combined with the separated hydrogen stream will equal an amount of hydrogen at least equal to the amount needed to sustain a continuous operation of the process;

(h) combining the segregated hydrogen flow with the separated hydrogen stream;

(i) heating and repressurizing the combined hydrogen stream to the temperature and pressure of the hydrogen in the first step;

(j) producing a second portion of said methane stream as a product gas, wherein said second portion is the amount of methane not subjected to processing in the steam reformer, water gas shift reactor and gas separator; and, (k) using the heated and repressurized hydrogen in the hydrogasifying step to continue the process.

2. The process of claim 1 wherein the hydrogen is at a temperature between about 700 and 1000 degrees Centigrade and at a pressure is between about 50 and 100 atmospheres.

3. The process of claim 1 wherein the temperature and pressure of the hydrogen is adjusted to obtain the highest concentration of methane to minimize recirculating hydrogen pumping costs while maintaining high rates of reaction.

4. The process of claim 1 wherein separating the outflow of hydrogen, methane, and carbon dioxide is performed by two pressure swing adsorption units.

5. The process of claim 1 wherein separating the outflow of hydrogen, methane, and carbon dioxide is accomplished by cryogenic separation.

6. The process of claim 1 wherein separating the outflow of hydrogen, methane, and carbon dioxide is performed by a single pressure swing adsorption unit employing a mixed adsorbent bed to adsorb both the carbon dioxide and the methane at high pressure and to intermittently differentially desorb at lower pressure.

7. The process of claim 1 wherein heating and repressurizing the combined hydrogen stream is performed by heat exchanging the combined hydrogen stream with hot cleaned gas and subjecting the combined hydrogen stream to a gas-fired heater.

8. The process of claim 1 wherein the hydrogasifying step is performed above ground in a reactor wherein the steady state reaction temperature is between about 700 and 1000 degrees Centigrade and the reaction pressure is between about 50 and 100 atmospheres.

9. The process of claim 1 wherein processing the cooled reaction effluent through a water gas shift reactor takes place at a temperature of about 250 degrees centigrade.

10. The process of claim 1 wherein the hydrogasifying step is performed by injecting the hydrogen into an above ground reaction chamber containing a hydrocarbon fuel.

11. The process of claim 1 wherein the hydrogasifying step is performed by injecting hydrogen into an underground coal bed; and, extracting the reaction effluent from said underground coal bed for processing above ground.

12. The process of claim 11 further comprising the step of combusting oxygen or air with the hydrogen prior to injecting the hydrogen into an underground coal bed.

13. The process of claim 11 wherein the hydrogasifying step is further performed by degassing the underground coal bed prior to injecting hydrogen into the underground coal bed.

14. The process of claim 11 wherein the hydrogasifying step is further performed by dewatering the underground coal bed prior to injecting hydrogen into the underground coal bed.

15. The process of claim 11 further comprising the step of combusting hydrogen with oxygen or air to compensate for excessive heat losses underground prior the step of using the heated and repressurized hydrogen.

16. A continuous process for producing substitute natural gas and other products from a carbon containing resource having little or no oxygen comprising the steps of, (a) hydrogasifying the carbon-containing resource using hydrogen at a temperature and pressure sufficient to form a reaction effluent composed primarily of methane;

(b) cleaning the reaction effluent to remove gases other than methane and particulates to produce a methane stream;

(c) cooling the methane stream to a temperature suitable for processing;

(d) processing a first portion of said methane stream in a steam reformer, water gas shift reactor and gas separator to produce segregated flows of hydrogen and carbon dioxide, wherein the quantity of said first portion is the amount of methane that will yield after such processing a quantity of hydrogen at least equal to the amount needed to sustain a continuous operation of the process;

(e) heating and repressurizing the segregated hydrogen flow to the temperature and pressure of the hydrogen in the first step;

(f) producing a second portion of said methane stream as a product gas, wherein said second portion is the amount of methane not subjected to processing in the steam reformer, water gas shift reactor and gas separator; and, (g) using the heated and repressurized hydrogen in the hydrogasifying step to continue the process.

17. A continuous process for producing substitute natural gas and other products comprising the steps of, (a) hydrogasifying a carbon-containing resource using hydrogen at a temperature and pressure sufficient to form a reaction effluent composed primarily of methane, hydrogen and carbon monoxide;

(b) cleaning the reaction effluent to remove gases other than methane, hydrogen and carbon monoxide and particulates;

(c) cooling the cleaned reaction effluent to a temperature suitable for processing in a water gas shift reactor;

(d) processing the cooled reaction effluent through a water gas shift reactor to convert the carbon monoxide to hydrogen to a gaseous outflow of hydrogen, methane, and carbon dioxide;

(e) separating said outflow of hydrogen, methane, and carbon dioxide into separate streams;

(f) producing said carbon dioxide stream as a product gas;

(g) processing a first portion of said methane stream in a steam reformer to produce a hydrogen and carbon dioxide stream, wherein the quantity of said first portion is the amount of methane that will yield after such processing a quantity of hydrogen that when combined with the separated hydrogen stream will equal an amount of hydrogen at least equal to the amount needed to sustain a continuous operation of the process;

(h) combining the hydrogen and carbon monoxide stream with the separated hydrogen stream to form a combined stream;

(i) heating and repressurizing the combined stream to the temperature and pressure of the hydrogen in the first step;

(j) producing a second portion of said methane stream as a product gas wherein said second portion is the amount of methane not subjected to processing in the steam reformer.

(k) using the heated and repressurized combined stream in the hydrogasifying step to continue the process.

* * * * *